United States Patent [19]

Shibata

[11] Patent Number: 4,630,581

[45] Date of Patent: Dec. 23, 1986

[54] SYSTEM FOR CONTROLLING VAPORIZED FUEL IN AN INTERNAL COMBUSTION ENGINE

[75] Inventor: Norio Shibata, Toyota, Japan

[73] Assignee: Toyota Jidosha Kabushiki Kaisha, Toyota, Japan

[21] Appl. No.: 666,251

[22] Filed: Oct. 29, 1984

[30] Foreign Application Priority Data

Jul. 31, 1984 [JP] Japan ..... 59-158733

[51] Int. Cl.[4] ..... F02M 25/08

[52] U.S. Cl. ..... 123/325; 123/520; 123/519; 123/339

[58] Field of Search ..... 123/518, 519, 520, 339, 123/325

[56] References Cited

U.S. PATENT DOCUMENTS 4,127,097 11/1978 Takimoto ..... 123/520
4,253,437 3/1981 Haramoto ..... 123/325
4,387,681 6/1983 Ikeura ..... 123/325
4,448,734 5/1984 Shibano ..... 123/519
4,467,769 8/1984 Matsumura ..... 123/520

FOREIGN PATENT DOCUMENTS 53-74620 7/1978 Japan ..... 123/520
0062955 4/1982 Japan ..... 123/518

*Primary Examiner*—Carl Stuart Miller
*Attorney, Agent, or Firm*—Kenyon & Kenyon

[57] ABSTRACT

An internal combustion engine provided with a device for cutting fuel during deceleration and a purge system for selectively opening and closing a fuel passageway from a charcoal canister to an intake system of the engine in accordance with the operating condition of the engine. The purge system is operated so that the passageway is closed when the fuel is cut, and the purge system is operated so that the passageway is opened and closed in accordance with the operating condition of the engine when the engine is in a deceleration condition other than the particular condition where the fuel is cut.

3 Claims, 16 Drawing Figures

SYSTEM FOR CONTROLLING VAPORIZED FUEL IN AN INTERNAL COMBUSTION ENGINE

BACKGROUND OF THE INVENTION

1. Field of the Invention

The present invention relates to a device for controlling vaporized fuel in an internal combustion engine provided with a charcoal canister.

2. Description of the Prior Art

An internal combustion engine is usually provided with a device for cutting the fuel when the engine is in a deceleration condition so as to prevent overheating of a catalytic converter or the generation of so-called after fire. An internal combustion engine is also usually provided with a charcoal canister for temporarily holding the fuel vaporized from the fuel tank or float chamber of the carburetor. The canister is connected to the carburetor at a position located downstream of the throttle valve so that the fuel absorbed in the charcoal layer in the canister is desorbed due to the flow of purge air generated by the intake vacuum downstream of the throttle valve.

In such an internal combustion engine which provides both a fuel cutting system during deceleration and a system for the absorption and desorption of fuel by the canister, after fire would take place during deceleration if the fuel from the canister were introduced into the engine. In the prior art, the passageway from the canister is opened to the carburetor at an intake port (purge port) located slightly upstream of the throttle valve in its idle position. In this construction, the purge port is located upstream of the throttle valve during deceleration so that the introduction of fuel from the canister is prevented. However, the prevention of the introduction of fuel from the canister during deceleration renders ineffective operation of the canister during a running condition wherein the engine frequently experiences a number of alternate acceleration and deceleration operations, which condition is often realized when a vehicle is being operated in a city. This causes a certain amount of vaporized fuel to be emitted into the atmosphere, i.e., the vaporized fuel is not caught by the canister.

In order to overcome this drawback, there is known a system wherein the purge port is always located downstream of the throttle valve so that the introduction of vaporized fuel is attained even if the engine is under deceleration, the purge port including a control valve (purge control valve) for controlling the amount of vaporized fuel to be introduced (see Japanese Unexamined Patent Publication No. 53-74620). This system has, however, a drawback in that the catalytic converter can become overheated and after fire is apt to be generated at deceleration with a high engine speed due to the introduction of vaporized fuel.

SUMMARY OF THE INVENTION

An object of the present invention is to provide a canister purge system which is capable of overcoming the above-mentioned difficulties encountered in the prior art.

Another object of the present invention is to provide a canister purge control system which is capable of both preventing the generation of overheating of the catalytic converter and attaining effective use of the canister.

In accordance with the present invention, an internal combustion engine is provided which comprises:

an engine body;

an intake system connected to the engine body;

a throttle valve arranged in the intake system;

fuel passageway means opened to the intake system at a position downstream of the throttle valve in its idle position;

a canister provided therein with a layer for absorbing vaporized fuel, the canister having a purge air inlet on one side of the layer and a purge air outlet on the other side of the layer;

purge air passageway means for connecting the outlet of the canister with the intake system at a position always downstream of the throttle valve;

purge control valve means located in the purge air passageway means for controlling the introduction of vaporized fuel from the canister to the engine;

fuel-cut valve means for controlling the introduction of fuel from the fuel passageway means to the engine;

fuel-cut means responsive to a predetermined deceleration condition of the engine for operating the fuel-cut valve means so that the fuel passageway means are closed; and operating means for closing the purge control valve means to prevent the introduction of vaporized fuel when the fuel is cut by the fuel-cut means and for opening the purge control valve means in accordance with the operating conditions when the fuel is not cut.

DESCRIPTION OF THE PREFERRED EMBODIMENTS

Figure 1:
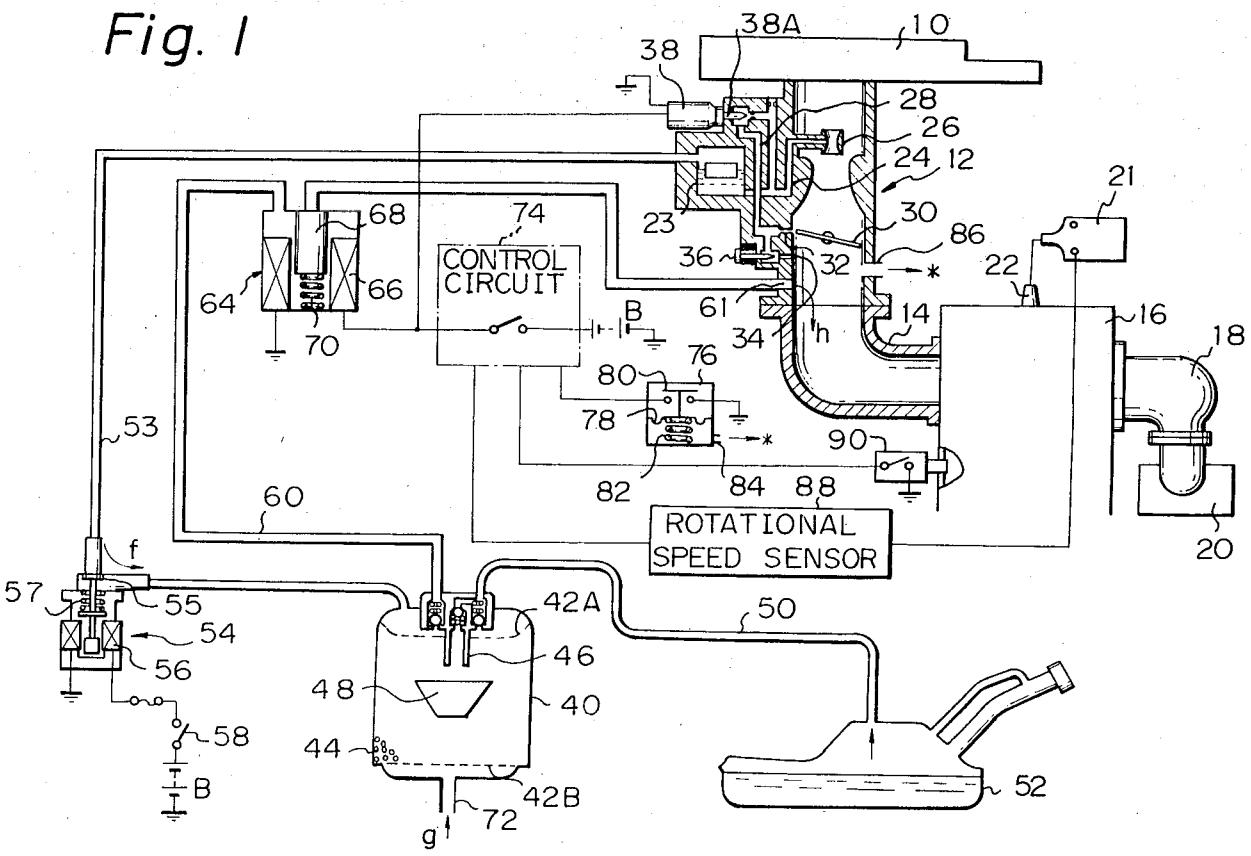
FIG. 1 is a schematic view showing a canister purge system in accordance with the present invention.

In FIG. 1 showing generally a system according to the present invention, reference numeral 10 denotes an air cleaner. The air cleaner 10 is connected to a carburetor 12, which is connected to an engine body 16 via an intake manifold 14. The engine body 16 is connected to a catalytic converter 20 via an exhaust manifold 18. Reference numeral 21 designates an ignition coil, which is connected to spark plugs 22 via a distributor (not shown).

The carburetor 12 is provided with a float chamber 23, to which a main fuel passageway 24 is opened at one end thereof. The other end of the main fuel passageway is opened to a small venturi 26. The carburetor 12 is further provided with a slow fuel passageway 28 which is connected to the main fuel passageway 24 at one end thereof. The other end of the slow fuel passageway 28 is connected to a slow port 32 located at a position near throttle valve 30 in its idle position, as well as to an idle port 34 located downstream of the slow port 32. An idle adjust screw 36 is arranged so as to control the opening of the idle port 34. Reference numeral 38 designates a fuel-cut solenoid having a valve portion 38A located in the slow passageway 28 for attaining fuel-cut control (described later) when the engine is under a deceleration condition.

The engine has a charcoal canister 40 provided therein with an absorption layer including charcoal material arranged between a pair of spaced perforated plates 42A and 42B. An inlet pipe 46 extends into the charcoal layer 44 so as to face a deflecting plate 48 arranged in the layer 44. The inlet 46 for vaporized fuel is connected via a pipe 50 to a fuel tank 52 to open to a space formed above the level of the fuel in the tank 52. The canister 40 is further connected via a second introduction pipe 53 to a float chamber 23 at a space formed above the level of the fuel in the float chamber 23. A control valve 54 is arranged on the second vapor fuel induction pipe 53. The valve 54 has a valve member 55, a solenoid 56, and a spring 57. The solenoid 56 is connected to a battery B via an ignition switch 58. Since the solenoid 56 is de-energized when the engine is stopped, wherein the ignition switch 58 is in an OFF condition, the spring causes the valve member 55 to be detached from the valve seat. As a result, the second induction pipe 53 is opened to permit the introduction of vaporized fuel from the float chamber 23 into the canister 40 via the pipe 53, shown by the arrow f, so as to be absorbed by the charcoal material 44. When the engine is operated with the switch 58 being in an ON condition, the solenoid 56 is energized so as to cause the valve member 55 to be displaced against the force of the sping 57 to close the valve seat. As a result, the induction pipe 53 is closed in order to disconnect the float chamber 23 from the canister 40.

The canister 40 is, on the side where the vaporized fuel inlet pipe 60 is mounted, connected to a purge port 61 located downstream the throttle valve 30 by way of a vaporized fuel induction pipe 60. A purge control valve 64 is arranged on the pipe 60. The purge control valve 64 has a solenoid 66, a valve member 68, and a spring 70. The valve 64 operates to control the introduction of vaporized fuel into the engine.

The canister 40 has at the side opposite to the inlet 46 a purge air inlet 72. The vacuum formed in the intake pipe of the engine at a position downstream of the throttle valve 30 causes a flow of air, shown by the arrow g, to be introduced into the canister 40. The fuel absorbed in the charcoal layer 44 is due to such flow of air desorbed and is introduced into the intake pipe at the port 61, shown by the arrow h.

The system is further provided with a control circuit 74 schematically illustrated in FIG. 1, which circuit provides signals direct to the fuel-cut solenoid 38 and to the solenoid 66 of the purge control valve 64 in accordance with operating condition signals provided by sensors. As one of the sensors, the vacuum sensor 76 has a diaphragm 78, a contact 80, and a spring 82, which diaphragm 78 is opened to a vacuum port 86 located downstream of the throttle valve 30 by way of a vacuum pipe 84. The vacuum sensor 76 is, as is shown in FIG. 2, in an OFF ("0") condition when the vacuum at the port 86 is lower than a predetermined limit Pcut, i.e., when the throttle valve opening is the vacuum sensor 76 is in an ON ("1") condition when the vacuum at the port 86 is higher than the predetermined value Pcut, i.e., when the throttle valve 30 is in an idle opening.

The rotational speed sensor 88 is a type which detects ignition pulse signals provided in the ignition coil 21. The sensor 88 includes a frequency-voltage transformer so that the pulse signals taken from the ignition coil 21 are changed to a continuously changing signal, the voltage level of which corresponds to the rotational speed of the engine. It should be noted that other types of rotational speed sensors may be employed. As is shown in FIG. 2, the rotational speed sensor 88 is connected to a first comparator 88A, as well as to a second comparator 88B. The first comparator 88A issues a "1" signal when the rotational speed of the engine is higher than a predetermined limit Ncut and issues a "0" signal when the rotational speed is lower than the value Ncut. It should be noted that a so-called hysteresis property may be provided, as is well known, so that the predetermined value Ncut is slightly varied between a condition where the engine speed is increasing and a condition where the engine speed is decreasing. The second comparator 88B issues a "1" signal when the engine speed N is higher than a predetermined set value Npurge and issues a "0" signal when the engine speed is lower than this value. It also should be noted that a similar hysteresis property may be provided for the switching between a state where the engine speed is increasing and a state where the engine speed is decreasing.

Further, an engine cooling water temperature sensor 90 is arranged on the engine body 16 so that its detecting end makes contact with cooling water in a water jacket in the engine body 16. The sensor 90 may be an electric switch operated by a thermo-sensitive material such as thermowax. The sensor 90 thus issues a "1" signal when the temperature of the cooling water is higher than a predetermined value Tpurge and issues a "0" signal when the temperature of the engine cooling water is lower than this value.

Figure 2:
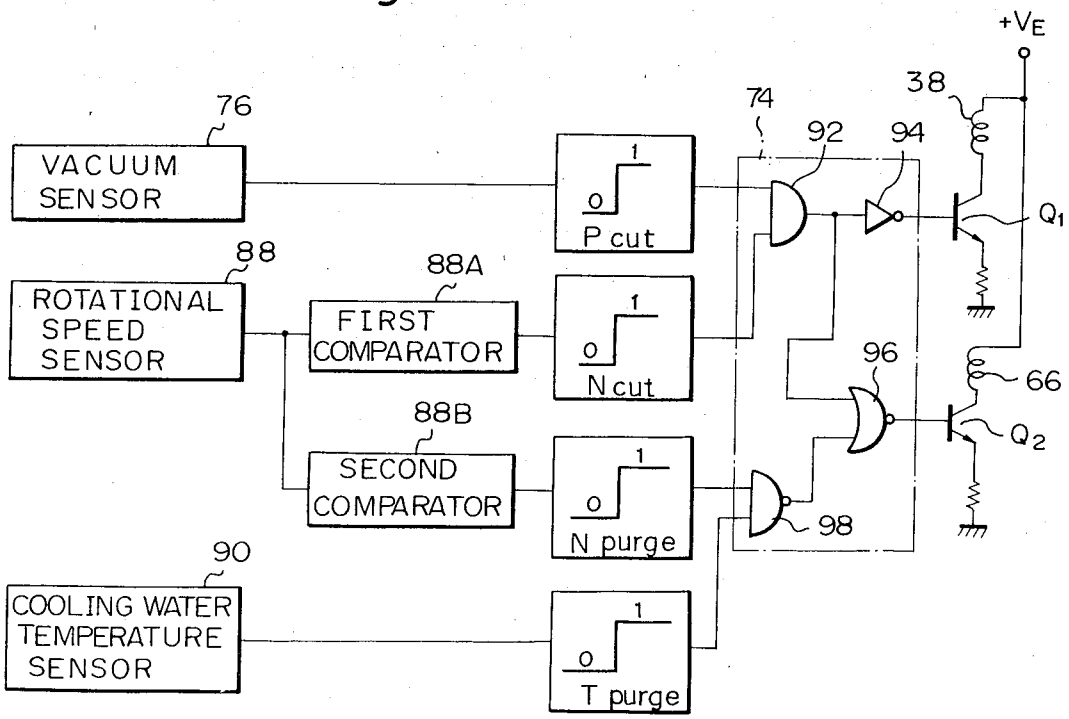
FIG. 2 is a diagrammatic view of the control circuit in FIG. 1.

The control circuit 74 has a logical circuit, as is shown in FIG. 2, comprising an AND gate 92, an OR gate 96, an AND gate 98, and an inverter 94. The AND gate 92 has a first input connected to the vacuum sensor 76 and a second input connected to the first comparator 88A of the rotational speed sensor 88. The AND gate 92 further has an output connected to the inverter 94, as well as to the OR gate 96 at its one input. The inverter 94 is connected to a transistor Q1 at its base. The fuel-cut solenoid 38 is arranged in a collector-emitter circuit of the transistor Q1 for operating the solenoid 38. The OR gate 96 has a further input which is connected to the AND gate 98 at its inverted output. The OR gate 96 has an inverted output which is connected to another transistor Q2 at its base. The solenoid 66 of the purge control valve 64 is arranged on a collector-emitter circuit of the transistor Q2 for operating the solenoid 66. The AND gate 98 has a first input connected to the second comparator 88B of the rotational speed sensor 88 and a second input connected to the engine temperature sensor 90.

Figure 3:
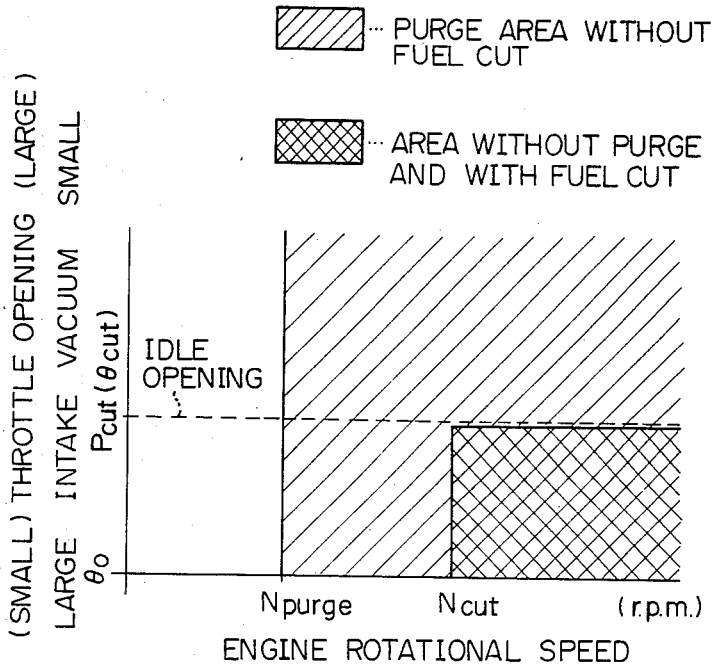
FIG. 3 shows a schematic diagram illustrating purge an introduction and the fuel-cut operations in accordance with the present invention.
Figure 5:
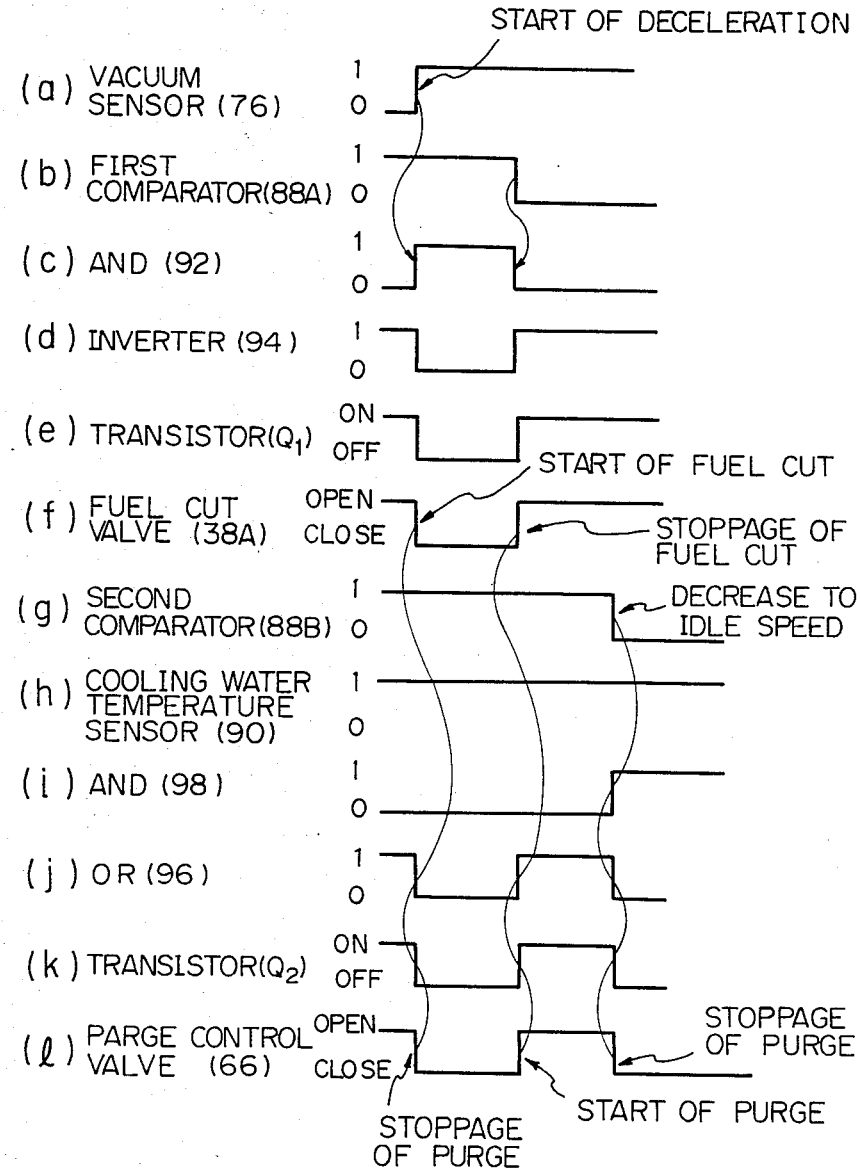
FIGS. 5(*a*)–5(*l*) show timing charts indicating the operation of the system according to the present invention.

Now the operation of the system according to the present invention will be described. When the engine is under a deceleration condition as is shown by the criss-crossed lines in FIG. 3 where the engine vacuum at the port 86 is higher than the predetermined value Pcut (corresponding to a degree of throttle opening $\theta$cut larger than the degree of throttle opening at a fully closed condition ($\theta_0$)) and where the rotational speed of the engine is higher than the predetermined level Ncut (for example, 2000 r.p.m.), the vacuum sensor 76, as well as the first comparator of the rotational speed sensor 88, issues "1" signals to the inputs of the AND gate 92 (FIG. 5(*a*) and FIG. 5(*b*)). The gate 92 provides a "1" signal at the output of the gate 92 (FIG. 5(*c*)). Therefore, the inverter 94 changes the "1" signal to a "0" signal supplied to the base of the transistor Q1 (FIG. 5(*d*)). Thus, the transistor Q1 assumes an "OFF" condition (*e*) wherein the fuel-cut solenoid 38 is de-energized as is shown by FIG. 5(*f*). As a result, the slow passageway 28 of the carburetor 12 is closed off so that a fuel-cut operation during deceleration is attained.

At the fuel-cut condition, a "1" signal always appears at the first input of the OR gate 96 connected to the output of the AND gate 92, as is shown by FIG. 5(*c*). The OR gate 96 issues at its inverted output a "0" signal (FIG. 5(*j*)), which causes the solenoid 66 of the purge control valve 64 to be de-energized. Therefore, the fuel induction pipe 60 is closed off so that the introduction of absorbed fuel is not effected during the deceleration condition where the fuel supply is cut.

When the engine is under the deceleration condition as is shown by the hatched area below the intake pressure of Pcut where the rotational speed of the engine is lower than Ncut, the first comparator 88A of the rotational speed sensor 88 issues a "0" signal so that the AND gate 92 attains a "0" signal at the output thereof, which signal is converted to a "1" signal by the inverter. Thus, the transistor Q1 is switched to the "ON" condition and thereby the fuel-cut solenoid 38 is energized. As a result, the fuel-cut valve 38A is positioned to open the slow passageway 28 of the carburetor 12. Therefore, a fuel-cut is prevented at this deceleration condition.

At this deceleration condition wherein the fuel-cut operation is stopped due to the relatively low engine speed, the OR gate 96 attains, at its first input connected to the AND gate 92, a "0" signal. The OR gate 96 attains, at its second input connected to the AND gate 98, a "0" signal so long as the AND gate 98 is in a condition where the output thereof issues a "0" signal, which condition is attained when the engine speed is higher than the predetermined value Npurge (for example, 1300 r.p.m.) and when the temperature of the cooling water is higher than the predetermined value Tpurge because both the second comparator 88A and the engine cooling water temperature sensor 90 issue "1" signals as is shown by FIG. 5(*g*) and FIG. 5(*h*), causing the AND gate 98 to provide a "0" signal at its inverted output. In this condition of the OR gate 96 wherein both inputs are "0" signals, the OR gate 96 issues a "1" signal at its inverted output, as is shown by FIG. 5(*j*). As a result, the transistor Q2 connected to the output of the OR gate 96 is switched to an "ON" ondition as shown by FIG. 5(*k*), causing the solenoid 66 of the purge control valve 64 to be energized so as to open the pipe 60. The introduction of purge air from the canister 40 together with fuel desorbed from the charcoal layer 44 is attained via the pipe 60, as is shown by FIG. 5(*l*), when the engine is under the deceleration condition where the rotational speed of the engine is lower than the value Ncut but higher than the value Npurge and where the cooling water temperature is higher than the value Tpurge. This deceleration condition corresponds to the hatched area below Pcut in FIG. 3.

Figure 4:
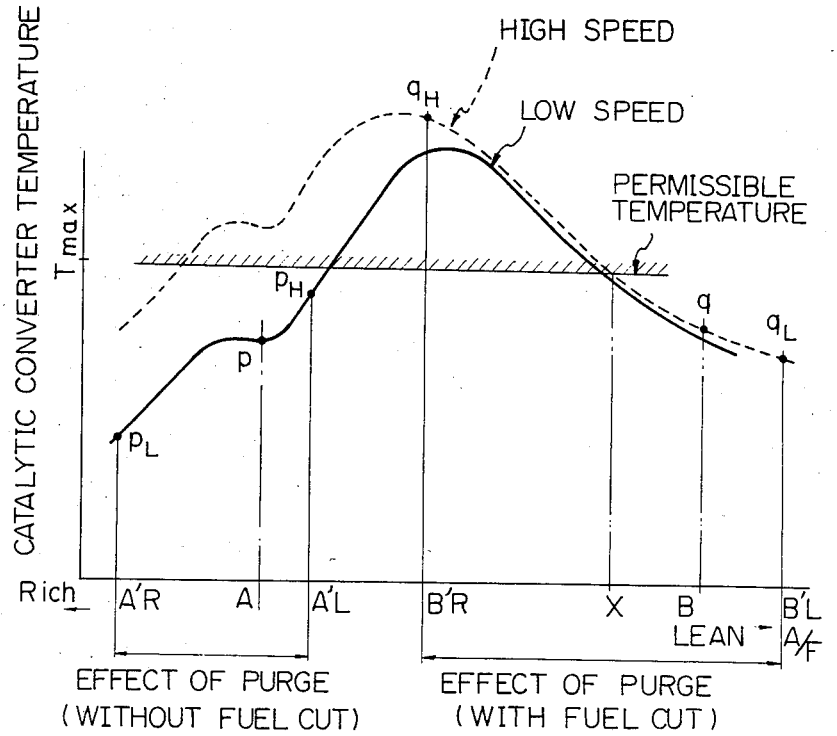
FIG. 4 shows the relationship between the air-fuel ratio and the temperature of the catalytic converter during deceleration of the engine at low and high rotational speeds.

FIG. 4 shows two relationships between the air-fuel ratio A/F and the temperature of the catalytic converter 20 during the deceleration condition of the engine, the solid-line curve corresponding to the low rotational speed of the engine and the broken-line curve corresponding to the high rotational speed of the engine. During the low rotational speed deceleration shown by the solid line, a fuel-cut operation is not attained while the introductin of vaporized fuel is attained. In this case, the air-fuel ratio basically has a value A. The amount of fuel introduced from the canister fluctuates to some extent. Therefore, the air-fuel ratio actually fluctuates between the leanest value A'L and the richest value A'R. Due to the fluctuation of the air-fuel ratio between A'L and A'R, the temperature of the catalytic converter fluctuates between the highest value $P_H$ and the lowest value $P_L$. These values $P_H$ and $P_L$ are, however, lower than the permissible value Tmax.

During the deceleration of a high engine speed wherein the supply of fuel is cut, the air-fuel ratio has a value B which is higher (lean) than the value A during the deceleration of a low engine speed. If the introduction of fuel from the canister is effected at this high-speed deceleration condition, as is the case in the prior art, the air-fuel ratio would change between the lowest value B'R and the highest value B'L due to the fact that the amount of desorbed fuel changes to some extent. In this case, the temperature of the catalytic converter 20 would, as is shown by the broken curve in FIG. 4, change between the highest value $q_H$ and the lowest value $q_L$, between which the value q of the temperature at the air-fuel ratio as a basic value is located. As can be seen from the broken curve in FIG. 4, the temperature of the catalytic converter would be higher than the permissible value Tmax if the air-fuel ratio were lower than the value X, causing the catalytic converter 20 to become overheated. In accordance with the present invention, during the deceleration condition of a high rotational speed wherein the supply of fuel is cut, the introduction of fuel from the canister 40 via the pipe 60 is stopped. Therefore, the air-fuel ratio at this condition is maintained at the basic value B so that the temperature of the catalytic converter is substantially maintained at the value q, which is lower than the permissible value Tmax. Thus, overheating of the catalytic converter 20 can be prevented.

Due to the purge operation during low engine speed deceleration, the canister 40 can effectively operate to absorb vaporized fuel during a condition wherein the engine attains frequent and alternate acceleration and deceleration, as is realized during the running of a vehicle in a city.

Due to the stoppage of the purge operation during high-speed deceleration, overheating of the catalytic converter is prevented.

When the engine is under an idling condition where the rotational speed of the engine is lower than the value Npurge, or the temperature of the engine cooling water is lower than the value Tpurge, the second comparator 88B of of the rotational speed sensor 88 or the engine cooling water temperature sensor 90 issues a "0" signal to the AND gate 98. Therefore, the gate 98 at its inverted output issues a "1" signal. Thus, the OR gate 96 issues at its inverted output a "0" signal, causing the transistor Q2 to be in an "OFF" condition. Therefore, the solenoid 66 of the purge control valve 64 is de-energized so that the valve 64 is closed to stop the introduction of vaporized fuel into the engine.

While an embodiment of the present invention is described with reference to the attached drawings, many modifications and charges may be made by those skilled in the art without departing from the scope of the invention.

What is claimed is:

1. An internal combustion engine comprising an engine body;

an intake system connected to the engine body;

a throttle valve arranged in the intake system;

fuel passageway means opened to the intake system at a position downstream of the throttle valve in its idle position;

a canister provided therein with a layer for absorbing vaporized fuel, said canister having a purge air inlet on one side of the layer and a purge air outlet on the other side of the layer;

second passageway means for connecting the outlet of the canister with the intake system at a position always downstream of the throttle valve;

purge control valve means for controlling the introduction of vaporized fuel from the canister to the engine;

fuel-cut valve means for controlling the introduction of fuel from the fuel passageway to the engine;

fuel-cut means responsive to a predetermined deceleration condition of the engine for operating the fuel-cut valve means so that the fuel passageway means are closed, including first sensor means for detecting a predetermined degree of throttle opening corresponding to the idle condition of the engine, second sensor means for detecting an engine speed lower than a predetermined value, and a first gate means responsive to signals from the first and the second sensor means for operating the fuel-cut valve means to close the fuel passageway means when the throttle opening is smaller than the predetermined degree while the engine speed is higher than the first predetermined value; and operating mens for closing the purge control valve means to prevent the introduction of vaporized fuel when the fuel is cut by the fuel-cut means and for opening the purge control valve means in accordance with the operating conditions, including at least engine speed, when the fuel is not cut.

2. An internal combustion engine according to claim 1 wherein said operating means comprise third sensor means for detecting an engine speed lower than said first predetermined value and second gate means connected to the third sensor means and to the first gate means for operating the purge control valve means in such a manner that said purge control valve means is closed when the rotational speed is higher than the first predetermined value and is opened when the rotational speed is lower than the first predetermined value but higher than the second predetermined value while the degree of the throttle opening is smaller than the predetermined degree.

3. An internal combustion engine according to claim 2, further comprising a fourth sensor means for detecting a predetermined temperature of the engine and a third gate means connected to the fourth sensor means, as well as to third sensor means, for operating the third gate means in such a manner that the purge control valve is closed when the temperature is higher than the predetermined value even if the rotational speed is higher than the second predetermined value.

* * * * *

UNITED STATES PATENT AND TRADEMARK OFFICE

CERTIFICATE OF CORRECTION

PATENT NO. : 4,630,581

DATED : December 23, 1986

INVENTOR(S) : Norio Shibata

It is certified that error appears in the above-identified patent and that said Letters Patent is hereby corrected as shown below:

Column 2, line 36, after "purge" insert --operations--.

Column 2, line 37, delete "an introduction".

Column 3, line 31, change "sping" to --spring--.

Column 3, line 49, change "is due" to --is, due-- and "air de-" to --air, de---.

Column 3, line 64, after "is" insert --greater than idle opening;--.

Column 6, line 4, change "introductin" to --introduction--.

Column 8, line 8, change "mens" to --means--.

Signed and Sealed this

First Day of September, 1987

*Attest:*

*Attesting Officer*

DONALD J. QUIGG

*Commissioner of Patents and Trademarks*